US006147444A

United States Patent [19]

Gallant et al.

[11] Patent Number: 6,147,444

[45] Date of Patent: Nov. 14, 2000

[54] LAMP WITH REFLECTOR HAVING SPECIFIC NECK PORTION

[75] Inventors: Joseph P. Gallant, Winchester; Peter R. Gagnon, Lexington, both of Ky.

[73] Assignee: Osram Sylvania Inc., Danvers, Mass.

[21] Appl. No.: 09/176,761

[22] Filed: Oct. 22, 1998

[51] Int. Cl.[7] ..... H01J 5/48

[52] U.S. Cl. ..... 313/318.01; 313/318.09; 313/318.11

[58] Field of Search ..... 313/318.01, 318.04, 313/318.07, 318.09, 25, 318.11

[56] References Cited

U.S. PATENT DOCUMENTS

| | | |
|---|---|---|
| 4,342,142 | 8/1982 | Nieda . |
| 4,816,977 | 3/1989 | Sorensen . |

FOREIGN PATENT DOCUMENTS

| | | |
|---|---|---|
| 0 516 231 A2 | 12/1992 | European Pat. Off. . |
| 0 100 294 A2 | 2/1998 | European Pat. Off. . |
| 29 38 189 A1 | 3/1981 | Germany . |
| 2 064 747 | 7/1981 | United Kingdom . |

*Primary Examiner*—Vip Patel
*Attorney, Agent, or Firm*—William E. Meyer

[57] ABSTRACT

A lamp such as a PAR lamp is provided wherein a metal base shell is attached to a neck portion of a reflector by three or more peens which extend into respective peen holes. In a preferred embodiment, respective of the peen holes are located (a) at opposite regions of the neck portion and (b) on opposite sides of a medial plane of the neck portion. The peen holes of such embodiment extend into the neck portion in a direction other than radially towards the axis which forms the centerline of the neck portion.

17 Claims, 3 Drawing Sheets

LAMP WITH REFLECTOR HAVING SPECIFIC NECK PORTION

TECHNICAL FIELD

The present invention relates to electric lamps. The present invention is particularly useful in connection with PAR lamps.

BACKGROUND ART

It is known to provide an electric lamp which includes a reflector, a base such as a metal base shell attached to the reflector, and a light source positioned within the reflector and electrically connected to the base. For example, a conventional PAR lamp includes a molded glass reflector having the general form of a dished portion leading to a neck portion which is formed around the axis of the reflector. Typically, at least two holes are formed in the neck portion to allow electrical connection to a light source positioned within the reflector. In particular, lead wires extend from a lamp positioned within the reflector. The lead wire extend through respective holes in the neck portion. Such lead wires are mechanically and electrically attached to a metal base shell which has been attached to the neck portion of the reflector. Typically, the base shell is a brass base shell which is threaded for screwing into a mating electrical socket in a conventional manner.

When providing electric lamps of this type, it is essential that the metal base shell be firmly attached to the neck portion of the reflector. For example, when a completed lamp is placed in use it may be threaded into a socket with excessive vigor causing the threads of the lamp and the threads of the socket to bind. Further, during use the threaded base shell may be subjected to corrosion, dirt, temperature cycling and the like that may also act to bind the threads. In such instances, when it is necessary to replace the lamp, the bound threads will require an undesirably excessive unthreading force. Depending upon the extent to which the threads are bound in the socket, in some instances such excessive unthreading force may cause the metal base shell to be separated from the reflector rather than cause the lamp to be unscrewed from the socket. When this occurs, removal of the lamp from the socket becomes very difficult. In addition the electrical connections and sharp and/or torn edges of the metal base shell will be exposed which will cause a potentially hazardous situation including the possibility of fire and injury to the user.

Efforts have been made to firmly secure the neck portion of the reflector to the metal base shell. For example, in PAR lamps it is known to secure the metal base shell to the glass reflector using either an adhesive or mechanical means. Although adhesives are effective, they must withstand high temperatures, and such adhesives tend to be expensive. Another disadvantage is that such adhesives are typically cured at high temperatures, and this tends to discolor the conventional brass metal base shell. Alternatively, a nickel plated brass base shell may be used to eliminate such discoloration. However, nickel plated brass base shells tend to be more costly and are more difficult to work with using an automated system than are brass base shells. In fact, when nickel plated brass base shells are provided hand assembly operations are favored.

Mechanical assembly of lamps such as PAR lamps is relatively inexpensive and automation friendly, but is more difficult to implement reliably. For example, a conventional PAR lamp is formed with two peen holes by pressing a glass gob between two mold faces. In particular, a glass gob is dropped into a female mold cavity, and a male mold face is pressed therein to form the reflector. Two slides each of which include a peen pin are brought in from opposite sides of the mold apparatus to plunge peen holes into the reflector neck portion. Such peen pins and therefore the peen holes are diametrically located. When the reflector is removed from the female mold, the threaded metal base shell is attached to the neck portion by pushing the metal base shell all the way down onto the neck portion. Respective portions of the metal base shell, referred to as peens, are then pressed into the peen holes provided in the neck portion of the reflector using a convectional peening tool. Typically, the neck portion is formed with a slope so as to be readily removable from the female mold. Due to a slight interference between the inside diameter of the metal base shell and the largest diameter of the neck portion of the glass reflector, the metal will be in tension when the base is pushed all the way down onto the neck portion. Such tension serves to hold the metal base shell in place during the peening operation. However, if the metal base shell is not properly pushed very tightly all the way down against a seating ledge of the reflector, there will be a tendency for the metal base shell to move along the axis of the neck portion before and/or during the peening operation. Similarly, if the metal base shell and/or neck portion are not properly toleranced to provide the required metal tension, there may be a further tendency for the metal base shell to move along the axis of the neck portion. Such movement of the metal base shell will adversely affect the interface between the peens and the peen holes and provide an inadequate attachment between the metal base shell and neck portion. Further problems may result from the nature of the pressing operation. For example, the peening operation provides a dilemma in that excessive pressing by the peening tool will fracture the glass reflector and possibly tear the metal of the metal base shell, and under pressing will prevent the peens from being sufficiently pressed into the peen holes to securely attach the metal base shell to the reflector. Potential problems exist even when the correct amount of pressure is applied. For example, typically the two peen holes are positioned diametrically, and such configuration provides an axis for the peens and therefore the metal base shell to pivot about relative to the reflector. When this occurs, the remaining portion of the metal base shell can then swivel or lift from the outer peripheral surface of the neck portion of the reflector. As a practical matter, this condition causes the peens to rock back and forth, thereby loosening the peens and/or causing them to rock out of the peen holes. This problem is compounded if the metal base shell is not properly seated and pressed squarely onto the neck portion since the metal base shell may be deformed during such inaccurate seating. When such a condition occurs, the metal base shell will flex around the neck portion of the reflector, and an undesirably shorter peen may be formed by the peening tool. When the peening tool is removed, the metal base shell will tend to flex back thereby lifting the shorter peen(s) further away from and possibly out of the peen hole(s). In addition to the foregoing, rocking of the metal base shell may tend to round off the peens which will cause the peens to slip from the peen holes. In those instances where there is a tendency for the peens to be removed from the peen holes, regardless of the cause, the metal base shell will break free from the neck portion of the reflector.

Efforts to provide lamps with more than two peens and respective peen holes to improve the attachment of the metal base shell to the reflector have been directed to embodiments wherein the holes are equally spaced around the metal base shell and are radially aligned; that is, the axis of each hole is extended towards the axis of the metal base shell and neck portion of the reflector. Production of such a lamp has not been practical due to the high cost of retooling. In particular, in present tool design wherein the neck portion of the reflector is provided with two diametrical peens, the space provided for producing the two peens, which are separated by 180°, is already occupied by the mechanism which retracts the current peen pins which effect the diametrically located opposing peens. Since there is no room for additional peen tools, the cost of providing a lamp with more than two peens is enormous.

Another problem which occurs during the manufacture of such a PAR lamp is that due to the limited space between the rim of the metal base shell and the first thread thereof, it is necessary for the edge of the peen hole to be tangent to the seating plane of the metal base shell. This presents the possibility of tearing through the rim of the metal base shell during the peening operation. Any such tearing completely destroys the strength of the metal base shell. Lamps damaged in this manner can not be shipped or sold under any circumstances.

DISCLOSURE OF THE INVENTION

It is an object of the present invention to provide an improved lamp.

Another object of the present invention is to provide a lamp having a threaded metal base attached to a reflector which may be removed from a threaded electrical socket without causing the reflector to break free from the metal base.

Yet another object of the present invention is to provide a lamp having a metal base which is firmly attached to a neck portion of a reflector.

A further object of the present invention is to provide a lamp which may be removed from an electrical socket without concern for causing a hazardous condition due to separation of a metal base from a reflector.

Another object of the present invention is to provide a lamp having a metal base attached to a neck portion of a reflector wherein there is no tendency for the base to pivot or otherwise move relative to the reflector.

A further object is to provide an improved lamp wherein a metal base is attached to a neck portion of a reflector without the need for an adhesive.

Yet a further object of the present invention is to provide a lamp having a metal base which is maintained squarely on a neck portion of a reflector.

A further object of the present invention is to provide a lamp exhibiting a substantially reduced tendency for peens of a metal base to come out of respective peen holes in a neck portion of a reflector attached to the metal base.

Another object of the present invention is to provide a lamp wherein the edge of the metal base adjacent the opening into which the neck portion of the reflector is inserted is not torn or otherwise damaged when the metal base is attached to the neck portion.

Yet another object of the present invention is to provide a lamp wherein peens of a metal base inserted into peen holes of a neck portion of a reflector are not subjected to wear or bending.

Another object of the present invention is to provide an improved PAR lamp.

A further object of the present invention is to provide a lamp wherein a metal base is attached to a neck portion of a reflector using three or more peens, and which is not costly to produce.

This invention achieves these, and other objects by providing a lamp which comprises a reflector, a metal base and a light source positioned in the reflector and electrically connected to the metal base. The reflector comprises a neck portion which includes an outer peripheral surface and extends in the direction of a neck portion axis. The neck portion includes at least two first holes extending from the outer peripheral surface into the neck portion at a first region of the neck portion and at least one second hole which extends from the outer peripheral surface into the neck portion at a second region of the neck portion. The first holes are located one each on either side of a medial plane of the neck portion and extend into the neck portion in a direction other than radially towards the first axis. The metal base is attached to the neck portion such that the metal base overlaps, and has base portions which extend into, the first and second holes. The light source positioned in the reflector is electrically connected through the neck portion to the metal base.

BRIEF DESCRIPTION OF THE DRAWINGS

This invention may be clearly understood by reference to the attached drawings in which like reference numerals designate like parts and in which.

MODE FOR CARRYING OUT THE INVENTION

Figure 1:
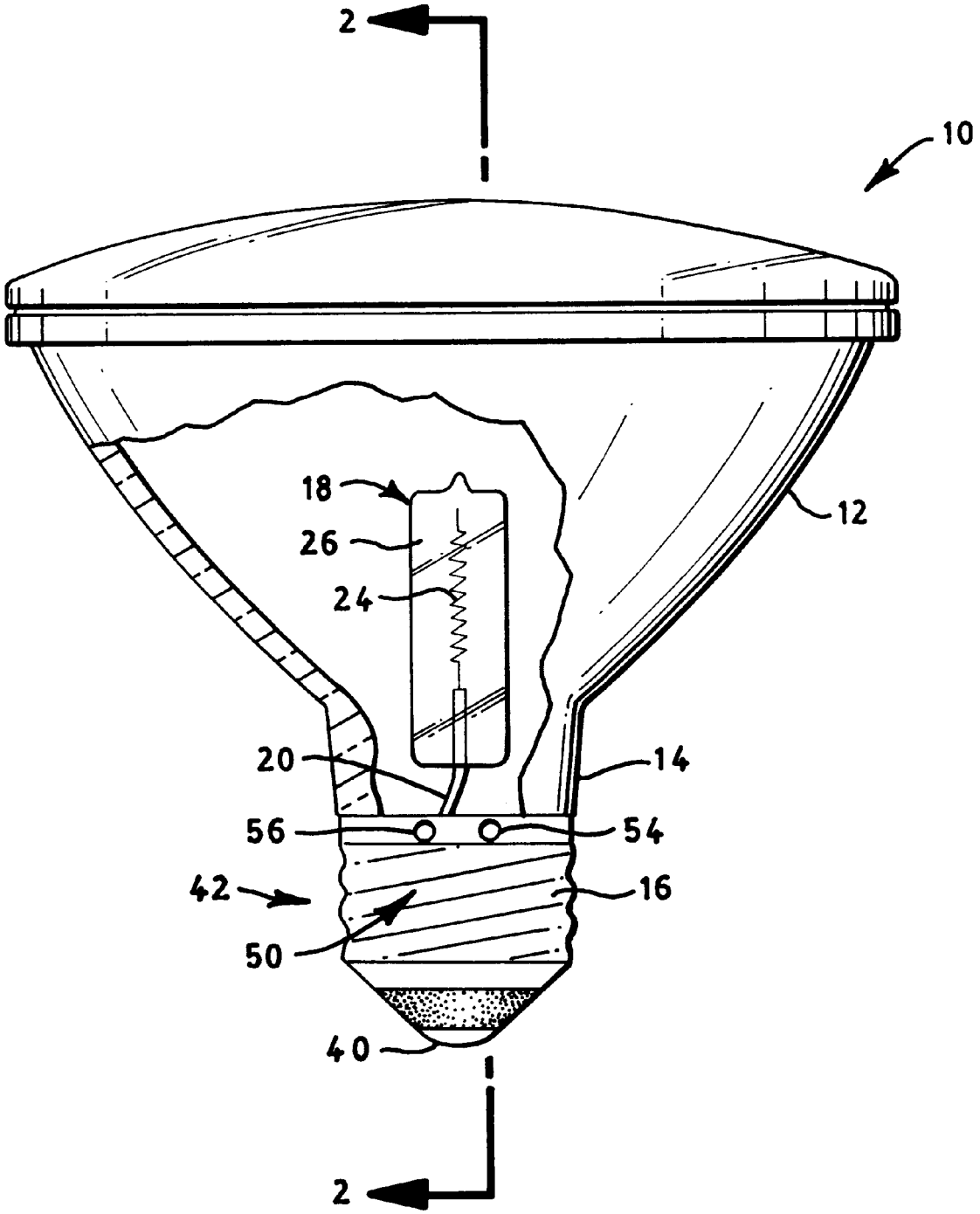
FIG. 1 is a view of one embodiment of a lamp of the present invention.

For a better understanding of the present invention, together with other and further objects, advantages and capabilities thereof, reference is made to the following disclosure and appended claims taken in conjunction with the above-described drawings.

The embodiment of this invention which is illustrated in the drawings is particularly suited for achieving the objects of this invention. In the embodiment illustrated in the drawings, a lamp 10 comprises a reflector 12 having a neck portion 14 and a base 16 attached to the neck portion. Without limitation, in the embodiment of FIGS. 1 to 3, base 16 is a threaded metal base shell. A light source 18 is positioned in the reflector 12 and electrically connected through the neck portion 14 to the metal base shell 16 in a conventional manner. For example, two lead wires 20 and 22 are electrically and mechanically connected to a lamp filament 24 located within a lamp bulb 26. Lead wires 20 and 22 extend from the lamp bulb 26 and pass through respective apertures 28 and 30 at the base 32 of the neck portion 14. Distal end 34 of lead wire 20 is welded to an inner surface 36 of the metal base shell 16, and distal end 38 of lead wire 22 is welded to contact 40, in a conventional manner. In the embodiment illustrated in the drawings, the neck portion 14 is a molded extension of the reflector 12 and the metal base shell 16 is threaded at 42 in a conventional manner for insertion into a mating internally threaded lamp socket (not shown). Without limitation, the lamp 10 may be a PAR lamp.

Figure 2:
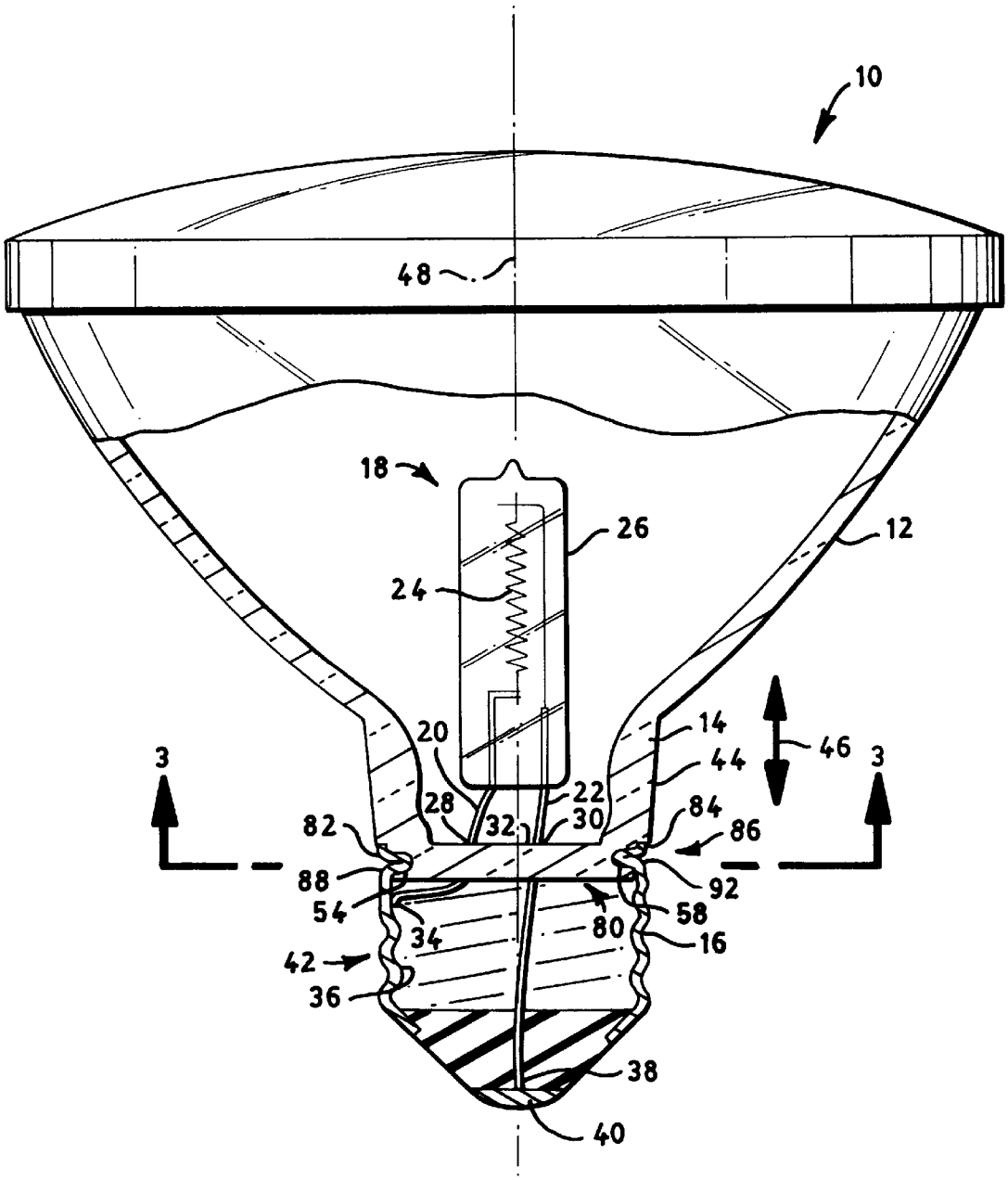
FIG. 2 is a partial cross sectional view taken along lines 2—2 of FIG. 1.
Figure 3:
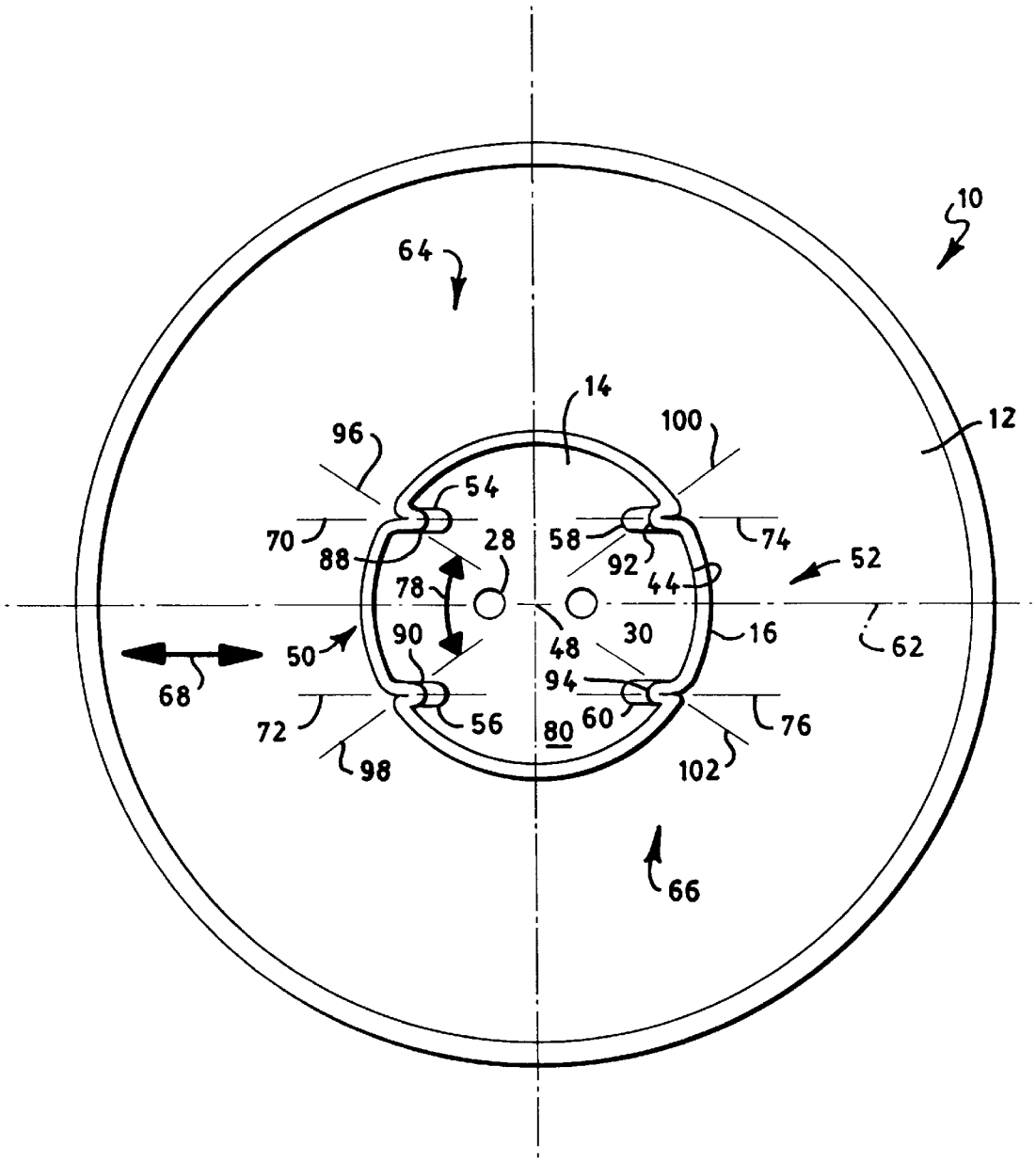
FIG. 3 is a view taken along lines 3—3 of FIG. 2

The neck portion 14 includes an outer peripheral surface 44 which generally extends in the direction 46 of a neck portion axis 48, which in the embodiment of FIG. 1 is also the axis of the lamp. The neck portion 14 is frusto conical as illustrated in FIGS. 1 and 2. With reference to FIG. 3, the neck portion 14 includes at least two first holes extending from the outer peripheral surface 44 into the neck portion at a first region 50 of the neck portion. Such first holes are located one each on either side of a medial plane of the neck portion as described hereinafter. The neck portion 14 also includes at least one second hole extending from the outer peripheral surface into the neck portion at a second region 52 of the neck portion. Without limitation, in the embodiment illustrated there are two first peen holes 54 and 56 at region 50 and two second peen holes 58 and 60 at region 52. With reference to FIG. 3, a medial plane which extends perpendicular to the drawing sheet and through axis 48 is represented by line 62. In the embodiment of FIGS. 1 to 3, a first hole 54 and an opposite second hole 58 are located on one side 64 of the medial plane 62, and a first hole 56 and an opposite second hole 60 are located on an opposite side 66 of the medial plane 62.

In accordance with the present invention, each first hole extends into the neck portion in a direction other than radially towards the axis 48. Although not necessary, in the embodiment illustrated in FIGS. 1 to 3, each second hole also extends into the neck portion in a direction other than radially towards the axis 48. For example, in the embodiment illustrated in FIGS. 1 to 3, each first peen hole 54 and 56 extends in the direction 68 of respective hole axes 70 and 72. Similarly, each second peen hole 58 and 60 extends in the direction 68 of respective hole axes 74 and 76. Axes 70, 72, 74 and 76 are parallel to the medial plane 62. In the embodiment of FIGS. 1 to 3, axes 70 and 74 are linearly aligned chordally across the circumference of the neck portion 14. Similarly, axes 72 and 76 are linearly aligned chordally across the circumference of the neck portion 14. By providing first and second holes each having an axis which is parallel with the medial plane 62 as illustrated in FIG. 3, first and second holes are provided which extend into the neck portion 14 in a direction other than radially towards the axis 48. It will be readily recognized by someone having ordinary skill in the art that one or more of axes 70, 72, 74 and 76 may be oriented in some other direction relative to medial plane 62 so long as axes 70 and 72 are not oriented radially towards axis 48.

In one embodiment, the first and second holes may be located approximately equiangularly relative to the neck portion axis. For example, in the embodiment illustrated in FIGS. 1 to 3, the holes 54, 56, 58 and 60 are approximately equally spaced around the outer peripheral surface 44, the holes being spaced at 78 about 90° (illustrated for clarity only between adjacent holes 54 and 58).

The metal base shell 16 is attached to the neck portion 14 of the reflector 12 by inserting the neck portion into the open end of the metal base shell so that the metal base shell overlaps the first and second holes which extend into the peripheral surface 44. For example, as illustrated in FIGS. 2 and 3, a first end 80 of the cylindrical neck portion 14 is inserted into a cylindrical open end 82 of the metal base shell 16 until the end 82 engages an abutment surface or ledge 84 of the reflector 12. Abutment surface 84 extends radially relative to axis 48 at an opposite second end 86 of the neck portion. In the embodiment of FIGS. 1 to 3, the metal base 16 completely overlaps the first holes 54, 56 and the opposite second holes 58, 60. Attachment of the metal base 16 to the neck portion 14 is effected by providing base portions such as peens 88, 90, 92 and 94 of the metal base 16 which extend into holes 54, 56, 58 and 60, respectively. In the embodiment illustrated in FIGS. 1 to 3, end 82 of the metal base 16 is adjacent the first holes 54, 56 and second holes 58, 60, and base portions 88, 90, 92 and 94 are structured and arranged so as to be offset from, and therefore not to overlap, the end 82. In the embodiment illustrated in FIGS. 1 to 3, the base portions 88, 90, 92 and 94 extend in the direction of respective axes 96, 98, 100 and 102 which extend radially towards the first axis 48.

It is believed that lamps structured and arranged in accordance with the present invention are stronger than conventional lamps having two diametrical peens and respective peen holes which provide a common pivot axis.

For example, by providing a lamp wherein the neck portion of the reflector has four peen holes the axis of each of which extends in a direction other than radially towards the axis of the neck portion, it is possible to provide a lamp wherein there is substantially no tendency for the metal base shell of the lamp to pivot or rock relative to the reflector as there is no common pivot axis. As a practical matter, at least the two first peen holes are disposed off of the neck portion axis or centerline thereby substantially eliminating any rocking condition. Such prevention of pivoting or rocking substantially reduces the tendency for the peens of the metal base to come out of respective peen holes or to become worn or bent and thereby reduces the tendency for the metal base to become unattached from the reflector. Any rotational movement of the metal base shell relative to the neck portion of the reflector will be prevented by any two of the peens extending into respective peen holes. In addition, by providing peens and respective peen holes as described herein, the need for interference between the neck portion of the reflector and the inner diameter of the metal base shell is diminished. This feature allows more forgiveness for the natural variations in pressed glass. In addition, the metal base shell may be attached to and maintained squarely on the neck portion of the reflector without an adhesive. Further, by increasing the number of peens and peen holes it is possible to slightly decrease their size which permits positioning of the peens and peen holes further from the seating plane of the metal base shell. For example, by providing four peens and four peen holes as illustrated in FIGS. 2 and 3, their size may be reduced sufficiently so that they can be further distanced from the seating ledge 84 and the base edge of the end 82 of the metal base shell 16 without interfering with the threads 42. In this manner, the edge at the end 82 of the metal base shell 16 will not be torn during the peening process, and the peens will therefore be offset from and not overlap such end, thereby assuring that the base metal shell will be firmly attached to the neck portion of the reflector. The foregoing features provide an improved lamp having, for example, a threaded metal base firmly attached to a reflector, which may be removed from a mating threaded electrical socket without causing the reflector to break free from the metal base. Such a lamp eliminates concern of creating a hazardous condition due to separation of the metal base and reflector.

The lamp of the present invention may be fabricated without major modification of existing equipment. For example, molding equipment which presently includes two slides each having a single peen pin which is moved radially towards the neck portion axis to form one of the peen holes of the two diametrical peen holes in the neck portion, may be readily modified. For example, one or both of the conventional diametrically disposed single peen pins may each be replaced with a pair of peen pins, each such pair including two off radius peen pins which are on opposite sides and are equidistant from and parallel to the medial plane of the neck portion. Such an apparatus will produce the lamp illustrated in FIGS. 1 to 3.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A lamp, comprising:

a reflector having a neck portion, said neck portion including an outer peripheral surface and extending in the direction of a neck portion axis, said neck portion including at least two first holes extending from said outer peripheral surface into said neck portion at a first region of said neck portion and at least one second hole extending from said outer peripheral surface into said neck portion at a second region of said neck portion, said at least two first holes being located one each on either side of a medial plane of said neck portion and extending into said neck portion in a direction other than radially towards said first axis;

a metal base attached to said neck portion, said metal base overlapping, and having base portions extending into, said at least two first holes and said at least one second hole; and a light source positioned in said reflector and electrically connected through said neck portion to said metal base.

2. The lamp of claim 1 wherein each hole of said at least two first holes and said at least one second hole extends in the direction of a respective hole axis, each hole axis being parallel to said medial plane.

3. The lamp of claim 2 wherein said at least two first holes comprise two first holes and said at least one second hole comprises two second holes, said at least two second holes being located one each on either side of said medial plane.

4. The lamp of claim 3 wherein said hole axis of one of said first holes is aligned with said hole axis of one of said second holes, and further wherein said hole axis of another of said first holes is aligned with said hole axis of another of said second holes.

5. The lamp of claim 1 wherein said at least two first holes and said at least one second hole are located approximately equiangularly relative to said neck portion axis.

6. The lamp of claim 1 wherein said metal base includes an end adjacent said at least two first holes and said at least one second hole, and further wherein said base portions are offset from and do not overlap said end.

7. The lamp of claim 1 wherein said base portions extend radially towards said first axis.

8. The lamp of claim 6 wherein said base portions extend radially towards said first axis.

9. The lamp of claim 8 wherein said two first holes and said two second holes are located approximately equiangularly relative to said neck portion axis.

10. A lamp, comprising:

a reflector having a molded neck portion having an outer peripheral surface and extending in the direction of a first axis from a first end to an opposite second end, at least first, second and third peen holes, said first peen hole extending from said outer peripheral surface into said neck portion at a first region of said neck portion on a first side of a medial plane of said neck portion, said second peen hole extending from said outer peripheral surface into said neck portion at said first region on an opposite second side of said medial plane, and said third peen hole extending from said outer peripheral surface into said neck portion at a second region of said neck portion, said at least first and second holes extending into said neck portion in a direction other than radially towards said first axis;

a threaded metal base shell attached to said neck portion, said metal base shell overlapping, and having at least a first peen, second peen and third peen extending into, said at least first, second and third peen holes, respectively; and a light source positioned in said reflector and electrically connected through said neck portion to said metal base shell.

11. The lamp of claim 10 wherein said reflector further includes a fourth peen hole extending from said outer peripheral surface into said neck portion at said second region, said third peen hole and said fourth peen hole extending into said neck portion in a direction other than radially towards said first axis, said third peen extending into said neck portion on said first side of said medial plane, and said fourth peen extending into said neck portion on said opposite second side of said medial plane, and wherein said threaded metal base shell further includes a fourth peen extending into said fourth peen hole.

12. The lamp of claim 11 wherein said first, second, third and fourth peen holes each extend in the direction of a respective hole axis, each hole axis being parallel to said medial plane.

13. The lamp of claim 12 wherein said hole axis of said first peen hole is aligned with said hole axis of said third peen hole, and said hole axis of said second peen hole is aligned with said hole axis of said fourth peen hole.

14. The lamp of claim 13 wherein said first, second, third and fourth peen holes are located approximately equiangularly relative to said neck portion axis.

15. The lamp of claim 13 wherein said metal base shell includes an end adjacent said first, second, third and fourth peen holes, and further wherein said first, second, third and fourth peens are offset from and do not overlap said end.

16. The lamp of claim 15 wherein said first, second, third and fourth peens each extend radially towards said first axis.

17. The lamp of claim 16 wherein said first, second, third and fourth peen holes are located approximately equiangularly relative to said neck portion axis.

* * * * *